US009879570B2

(12) United States Patent
Todo et al.

(10) Patent No.: US 9,879,570 B2
(45) Date of Patent: Jan. 30, 2018

(54) LIFTER

(71) Applicant: OTICS CORPORATION, Nishio-shi, Aichi (JP)

(72) Inventors: Kimihiko Todo, Nishio (JP); Daiki Miyazawa, Nishio (JP); Tatsuya Sasaki, Nishio (JP)

(73) Assignee: OTICS CORPORATION, Aichi (JP)

( * ) Notice: Subject to any disclaimer, the term of this patent is extended or adjusted under 35 U.S.C. 154(b) by 0 days.

(21) Appl. No.: 15/209,873

(22) Filed: Jul. 14, 2016

(65) Prior Publication Data

US 2017/0051637 A1 Feb. 23, 2017

(30) Foreign Application Priority Data

Aug. 19, 2015 (JP) ..... 2015-161571

(51) Int. Cl.
*F01L 1/14* (2006.01)
*F02M 59/10* (2006.01)

(52) U.S. Cl.
CPC ..... *F01L 1/14* (2013.01); *F01L 1/143* (2013.01); *F01L 1/146* (2013.01); *F01L 2103/00* (2013.01); *F01L 2105/00* (2013.01); *F01L 2105/02* (2013.01); *F01L 2107/00* (2013.01); *F02M 59/102* (2013.01)

(58) Field of Classification Search
CPC ... F01L 1/14; F01L 1/146; F01L 1/143; F01L 2105/02; F01L 2105/00; F01L 2107/00; F01L 2103/00; F02M 59/102
USPC ..... 123/90.5
See application file for complete search history.

(56) References Cited

U.S. PATENT DOCUMENTS

| | | | |
|---|---|---|---|
| 5,263,386 | A | 11/1993 | Campbell et al. |
| 2013/0152885 | A1 | 6/2013 | Remala et al. |
| 2013/0340695 | A1 | 12/2013 | Fujii et al. |

FOREIGN PATENT DOCUMENTS

| | | | |
|---|---|---|---|
| EP | 2 386 747 | A1 | 11/2011 |
| EP | 2 677 124 | A1 | 12/2013 |
| JP | 2012-002115 | A | 1/2012 |
| WO | WO2012/092095 | * | 7/2012 |

OTHER PUBLICATIONS

European Search Report dated Aug. 25, 2016 in European Patent Application No. 16 001 455.1 (9 pages).

* cited by examiner

*Primary Examiner* — Zelalem Eshete
(74) *Attorney, Agent, or Firm* — Smith, Gambrell & Russell, LLP

(57) ABSTRACT

A lifter includes a roller caused to abut against a cam thereby to be pressed and a lifter body rotatably supporting the roller and housed in a guide hole of a lifter guide so as to be reciprocable in the guide hole. The lifter body includes a cylindrical part and a rotation stopper. The cylindrical part has an outer periphery formed into a cylindrical shape such that the outer periphery is slidable on an inner periphery of the guide hole. The cylindrical part has one of two axial ends, the one end being formed with a skirt covering the roller. The rotation stopper is formed to protrude outward from the other axial end of the cylindrical part, the other axial end being located opposite a side where the skirt is located. The rotation stopper prevents the lifter body from being rotated about an axis thereof relative to the lifter guide.

14 Claims, 3 Drawing Sheets

LIFTER

CROSS-REFERENCE TO RELATED APPLICATIONS

This application is based upon and claims the benefit of priority from the prior Japanese Patent Application No. 2015-161571 filed on Aug. 19, 2015, the entire contents of which are incorporated herein by reference.

BACKGROUND

1. Technical Field

The present invention relates to a lifter.

2. Related Art

Japanese Patent Application Publication No. JP-A-2012-2115 discloses a lifter which is a roller lifter for use with internal combustion engines such as automobile engines. The disclosed lifter includes a lifter body and a roller which is caused to abut against an outer periphery of a cam thereby to be pressed. The lifter body includes a cylindrical part having an outer periphery slidable on an inner wall of a cylinder and a pair of supports axially protruding from one axial end of the cylindrical part. The roller is rotatably mounted on a support pin extending through both supports.

The cylindrical part has a rotation stopper formed to protrude outward on the one axial end of the cylindrical part, which end is located at the same side as the side where the supports for the roller are located. The rotation stopper prevents the lifter body from being rotated relative to the cylinder. The rotation stopper is slidably fitted in a rotation stopper groove formed along an inner wall of the cylinder.

In the lifter of the above-described type, a predetermined gap is defined between an outer periphery of the cylindrical part of the lifter body and the inner wall of the cylinder in order to guarantee smooth reciprocation of the lifter body. The lifter body would possibly be inclined relative to the inner wall of the cylinder when pressed by the cam in a range of the gap. If the lifter body is inclined, diagonal corners of the cylindrical part come into uneven contact with the inner wall of the cylinder (cocking). As a result, there would be a possibility of sliding wear of the inner wall of the cylinder in addition to occurrence of noise.

In view of the above-described problem, if the cylindrical part is supposedly extended to the one axial end side so that a guide length (a sliding region) of the cylindrical part is increased, the posture of the cylindrical part would be corrected with the result that cocking could be reduced. In this case, however, since the rotation stopper is located at the one axial end of the cylindrical part, the rotation stopper needs to be set not to enter a rotation trajectory of the cam. This limits the freedom in the design of the lifter to a large degree.

SUMMARY

Therefore, an object of the invention is to provide a lifter which has a high degree in the freedom of design and can reduce cocking.

According to one embodiment of the invention, a lifter includes a roller caused to abut against a cam thereby to be pressed and a lifter body rotatably supporting the roller and housed in a guide hole of a lifter guide so as to be reciprocable in the guide hole. The lifter body includes a cylindrical part having an outer periphery formed into a cylindrical shape such that the outer periphery is slidable on an inner periphery of the guide hole. The cylindrical part has one of two axial ends, the one axial end being formed with a skirt covering the roller. The cylindrical part also includes a rotation stopper formed to protrude outward from the other axial end of the cylindrical part, the other axial end being located opposite a side where the skirt is located. The rotation stopper prevents the lifter body from being rotated about an axis thereof relative to the lifter guide.

An axial dimension of the cylindrical part can be rendered larger since the cylindrical part of the lifter body has the skirt covering the roller. This can ensure a sufficiently large axial region in which the outer periphery of the cylindrical part slides on the inner periphery of the guide hole, with the result that the inclination of the lifter body in the guide hole can be reduced. Consequently, cocking due to inclination of the lifter body can be reduced.

Furthermore, the rotation stopper is formed to protrude outward from the other axial end of the cylindrical part, which other axial end is located opposite a side where the skirt is located. Thus, the rotation stopper is disposed at the position sufficiently deviated from the rotation trajectory of the cam. This resolves concern with the interference of the rotation stopper with the cam and accordingly improves the freedom in the design of the rotation stopper and its periphery. Moreover, since the rotation stopper is located at the other axial end of the cylindrical part but not at an axial middle of the cylindrical part, the lifter body can be ground by a centerless processing or the like while being rotated.

DETAILED DESCRIPTION

An embodiment of the present invention will be described with reference to the drawings. A lifter 10 according to the embodiment is a pump lifter mounted on a fuel supply system 80 of an internal combustion engine.

Figure 2:
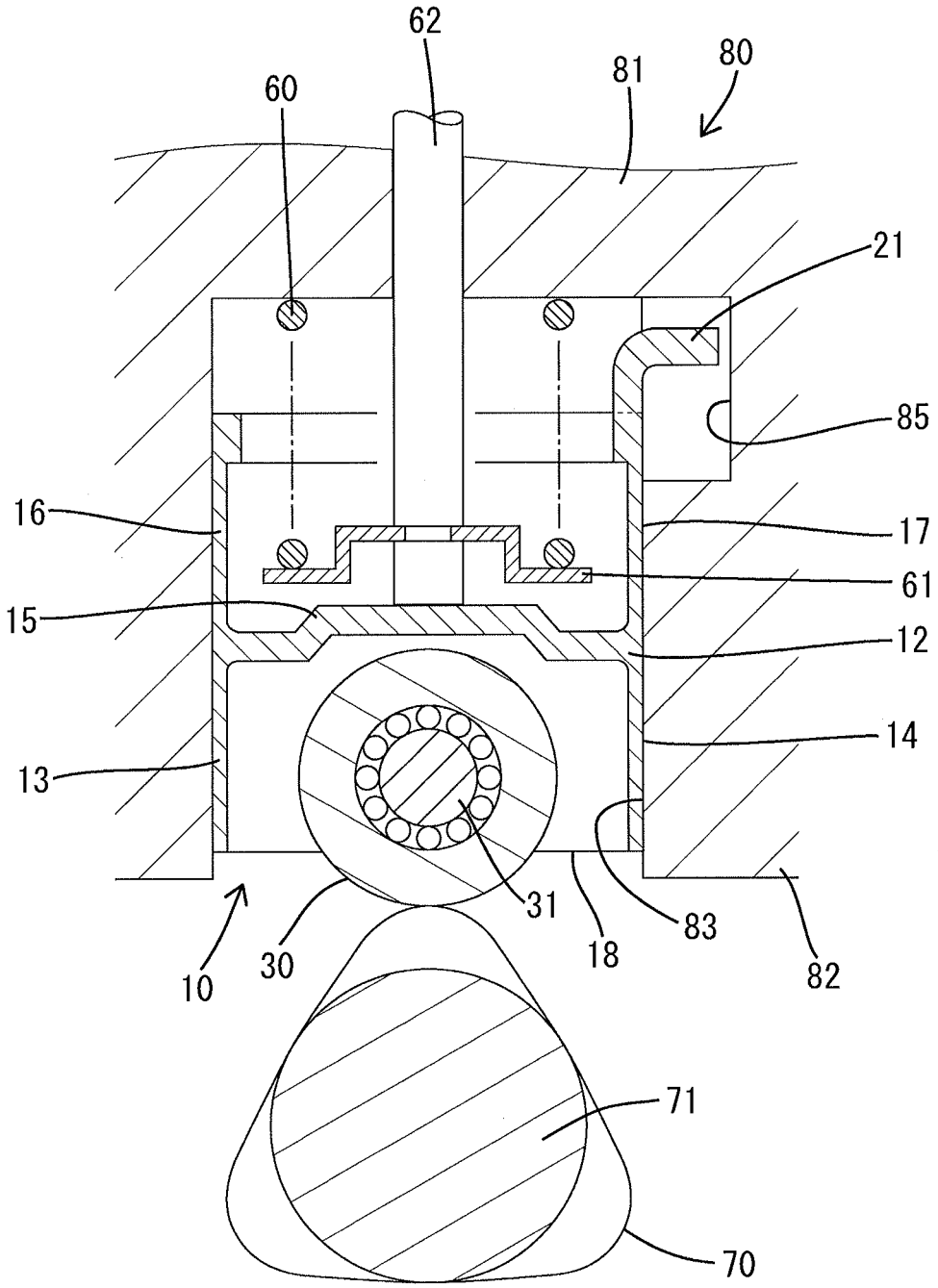
FIG. 2 is a sectional view of the lifter which is used as a pump lifter.

Referring to FIG. 2, the fuel supply system 80 includes, in addition to the lifter 10, a compression coil spring 60 biasing a roller 30 of the lifter 10 in a direction such that the roller 30 is pressed against a cam 70, a retainer 61 cooperative with an upwardly located cylinder 81 to retain the compression coil spring 60 therebetween, a plunger 62 housed in the cylinder 81 so as to be reciprocable, and a pump chamber (not shown) defined by the cylinder 81 and the plunger 62. The roller 30 will be described in detail later. The fuel supply system 80 includes a downwardly located cylinder which will be referred to as "a lifter guide 82" and is formed with a guide hole 83 extending in an axial direction or up-down direction as viewed in FIG. 2. The lifter 10 is reciprocably housed in the guide hole 83 of the lifter guide 82. The retainer 61 is attached integrally to an axial end (a lower end as viewed in FIG. 2) of the plunger 62.

When rotation of the cam 70 pushes the lifter 10 thereby to move the plunger 62 upward as viewed in FIG. 2, the cubic capacity of the pump chamber is reduced (a compression stroke). When further rotation of the cam 70 causes the plunger 62 together with the lifter 10 to move downward as viewed in FIG. 2, the cubic capacity of the pump chamber is increased (a suction stroke). The compression stroke and the suction stroke are repeated alternately, whereby fuel is compressed to be supplied into a delivery pipe and the like.

Figure 1:
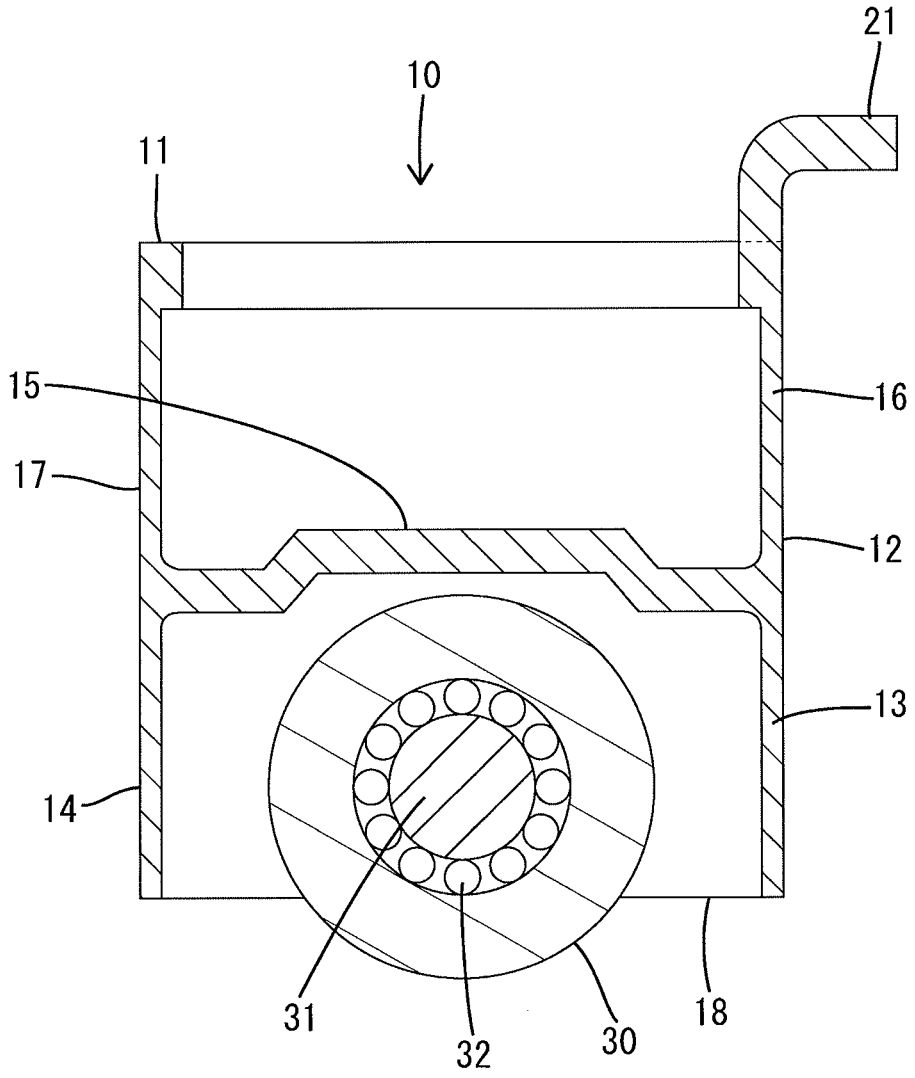
FIG. 1 is a schematic sectional view of a lifter according to one embodiment of the present invention.

The structure of the lifter 10 will now be described more concretely. The lifter 10 includes a lifter body 11 and a roller 30 as shown in FIG. 1. The lifter body 11 is integrally formed by forging such as cold forging in its entirety. A grinding process is applied to an outer periphery of the lifter body 11 after the forging process so that the lifter body 11 is completed. This processing manner renders the manufacture of the lifter body 11 easier and can keep the strength of the entire lifter body 11 high.

The lifter body 11 includes a cylindrical part 12 having an outer periphery slidable on an inner periphery of the guide hole 83 of the lifter guide 82. The cylindrical part 12 has two axial ends, one of which ends has a skirt 13 formed integrally with the axial end so as to cover a circumference of the roller 30.

Figure 3:
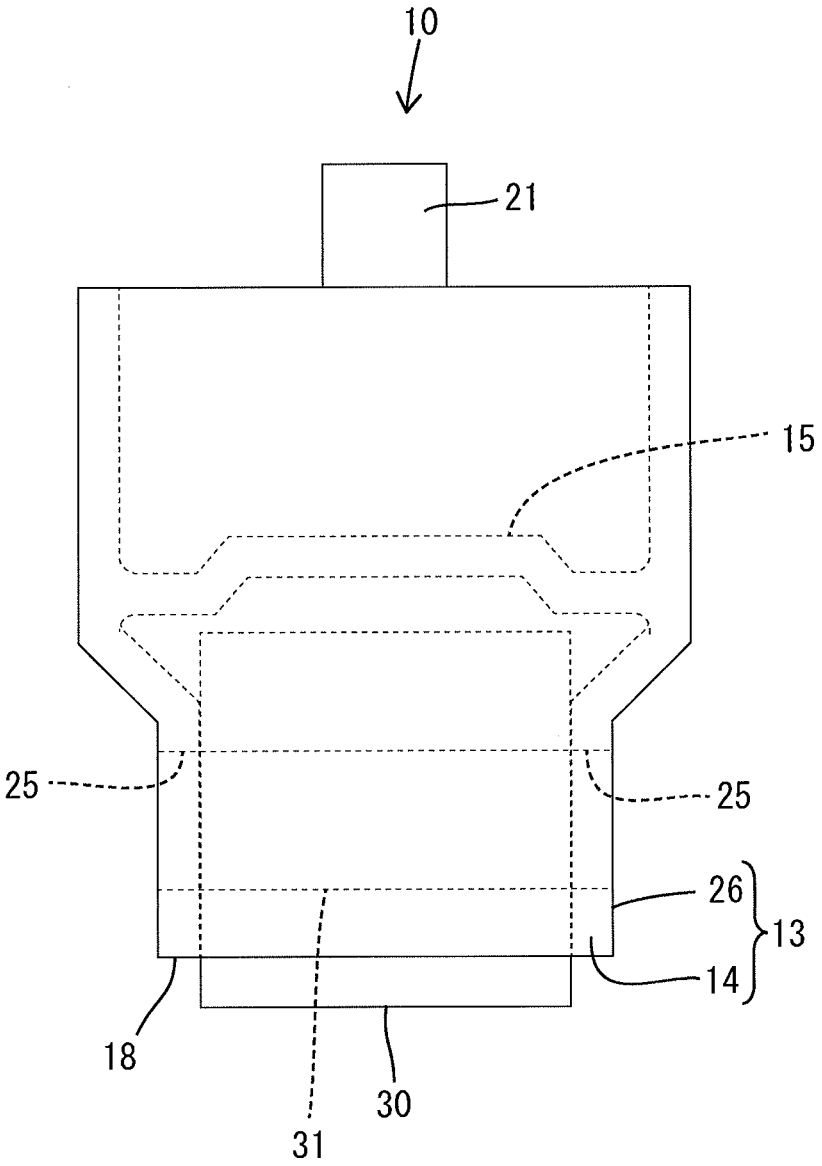
FIG. 3 is a schematic appearance diagram of the lifter.

The skirt 13 has an outer periphery formed with a pair of flat portions 26 having respective flat surfaces extending along an up-down direction. Each flat portion 26 has a shaft support hole 25 (see FIG. 3) extending therethrough in a thickness direction of the paper surface of FIG. 1. A support shaft 31 is coaxially inserted through the shaft support holes 25. The support shaft 31 has two ends fixed to the flat portions 26 by swaging respectively. The flat portions 26 are disposed to be parallel to each other. The support shaft 31 is disposed to be parallel to a cam shaft 71 on which the cam 70 is mounted (see FIG. 2). The roller 30 is rotatably supported on the support shaft 31 with a bearing 32, such as a needle bearing, being interposed therebetween.

The skirt 13 has a part excluding the above-described flat portions 26, and this part is formed into an arc-shaped portion 14 having an arc-shaped surface which is concentric with and slidable on an inner periphery of the guide hole 83. The arc-shaped portion 14 of the skirt 13 is disposed at a position opposed to an outer periphery of the roller 30 so as to cover the outer periphery of the roller 30. On the other hand, the flat portions 26 of the skirt 13 are disposed at positions opposed to end surfaces of the roller 30 so as to cover the end surfaces of the roller 30, respectively.

The skirt 13 has a distal end 18 which serves as the one axial end as shown in FIG. 2. The distal end 18 of the skirt 13 is disposed at a position deviated from a rotation trajectory of the cam 70 so as to be horizontal at a constant (the same) level. The roller 30 is disposed in abutment against the outer periphery (a cam surface) of the cam 70 from above as viewed in FIG. 2, while only a lower end of the roller 30 is exposed from the distal end 18 of the skirt 13.

The cylindrical part 12 has a partition wall 15 which is formed integrally with an axially middle part of the inner periphery of the cylindrical part 12 so as to extend radially. The cylindrical part 12 includes two axial end sides, one of Which is a lower side as viewed in FIG. 2 and the other of which is an upper side as viewed in. FIG. 2 with the partition wall 15 being located therebetween, The above-described skirt 13 is located at the one axial end side of the cylindrical part 12 and a cylindrical body 16 having an annular section is located at the other axial end side of the cylindrical part 12. The cylindrical body 16 and the partition wall 15 define an inner space in which are housed one axial end of the plunger 62, the retainer 61 and the compression coil spring 60, as shown in FIG. 2. The one axial end of the plunger 62 is supported in abutment against a radially middle positioned portion of the partition wall 15. The cylindrical body 16 has an outer periphery which is continuous with an outer periphery of the arc-shaped portion 14 with respect to an axial direction (in the up-down direction as viewed in FIG. 2) so as to be coplanar without any step, so that the outer periphery of the cylindrical body 16 is formed into a sliding surface 17. The sliding surface 17 has a substantially perfectly circular section and is slidable on the inner periphery of the guide hole 83 together with the outer periphery of the arc-shaped portion 14.

A rotation stopper 21 is formed integrally on the other axial end of the cylindrical part 12 or the cylindrical body 16, which other axial end is located opposite the side where the skirt 13 is located on the cylindrical part 12. The rotation stopper 21 prevents the lifter 10 from being rotated about the up-down axis relative to the lifter guide 82. The rotation stopper 21 protrudes from the other axial end of the cylindrical body 16 to the other axial side (upward as viewed in FIG. 2) and then bends radially outward, whereby the rotation stopper 21 is formed into a protruding piece having an L-shaped section. The rotation stopper 21 includes a part extending from a bent portion thereof to a free end. This part of the rotation stopper 21 is formed to have a larger thickness than the cylindrical part 12 inclusive of the skirt 13. Accordingly, the rotation stopper 21 is formed into a structure having a higher strength (stiffness) than the other part of the lifter body 11. On the other hand, the lifter guide 82 is provided with a rotation stopper groove 85 axially communicating with the guide hole 83 as shown in FIG. 2. The rotation stopper 21 is inserted into the rotation stopper groove 85 so as to be reciprocable.

The lifter 10 of the embodiment will work as follows. When the roller 30 is rotated about the support shaft 31 according to rotation of the cam 70, the lifter 10 is reciprocated by a stroke amount according to a lift amount of the cam 70, with the result that the sliding surface 17 of the cylindrical part 12 slidingly displaces on the inner periphery of the guide hole 83 of the lifter guide 82. In this embodiment, the skirt 13 is provided on the one axial end of the cylindrical part 12, so that the outer periphery of the arc-shaped portion 14 of the skirt 13 also serves as the sliding surface 17 and is slidable on the inner periphery of the guide hole 83. As a result, the lifter 10 has a formation range of the sliding surface 17 axially (in the up-down direction as viewed in FIG. 2) longer by the length of the skirt 13 than the conventional lifters.

According to the above-described embodiment, the posture of the lifter 10 can be stabilized, and the lifter 10 can be reciprocated in the guide hole 83 while the lifter 10 maintains the posture in which the axis line is directed in the up-down direction. Accordingly, although the lifter conventionally takes an inclined posture in the guide hole 83 due to a short axial dimension (height) of the lifter, this phenomenon can be reduced in the above-described embodiment, with the result that cocking of the lifter 10 with respect to the lifter guide 82 can effectively be reduced.

The rotation stopper 21 is reciprocated during the reciprocation of the lifter body 11 while being prevented from circumferential displacement relative to the rotation stopper groove 85, whereby the lifter 10 is prevented from being rotated about the axis thereof in the guide hole 83. In this case, since the rotation stopper 21 is formed to be thicker than the cylindrical part 12 inclusive of the skirt 13, the rotation stopper 21 is less subject to deformation even when intensely abutting against the groove surface of the rotation stopper groove 85, thereby maintaining the predetermined protruding shape. Furthermore, since the cylindrical part 12 which does not necessitate higher strength than the rotation stopper 21 is rendered relatively thinner, the material can be saved and the lifter body 11 can be rendered lightweight.

The rotation stopper 21 is formed to protrude from the other axial end of the cylindrical part 12 and is disposed opposite the skirt 13 located at the one axial end of the cylindrical part 12. Accordingly, the rotation stopper 21 can substantially be prevented from entering the rotation trajectory of the cam 70 abutting against the roller 30 provided on the inner side of the skirt 13, thereby preventing the cam 70 from becoming an obstacle when the shape, the protruding dimension and the like of the rotation stopper 21 are set.

Furthermore, since the rotation stopper 21 is formed to protrude from the other axial end of the cylindrical part 12, the outer periphery of the cylindrical part 12 can be ground while the lifter body 11 is rotated by a centerless processing. This does not necessitate troublesome grinding, thereby reducing the manufacturing costs. In this respect, if the rotation stopper 21 is formed to protrude from an axial middle of the cylindrical part 12, differing from the foregoing embodiment, the rotation stopper 21 would be an obstacle to the centerless processing with the result that the centerless processing cannot be carried out. Thus, the foregoing embodiment obviously has advantage over the above-mentioned supposed manner.

Furthermore, in the foregoing embodiment, the skirt 13 is provided with the paired flat portions 26 parallel to each other. The flat portions 26 are formed with the respective shaft support holes 25 through which the support shaft 31 of the roller 30 is coaxially inserted. The portion excluding the flat portions 26 in the skirt 13 is formed into the arc-shaped portion 14 having the outer periphery slidable on the inner periphery of the guide hole 83. The flat portions 26 are disposed opposite to the end surfaces of the roller 30 so as to cover the end surfaces of the roller 30, respectively. The arc-shaped portion 14 is disposed opposite to the outer periphery of the roller 30 so as to cover the end surfaces of the roller 30. Thus, the arc-shaped portion 14 is slidable on the inner periphery of the guide hole 83, whereby the cylindrical part 12 can ensure a sufficiently wide sliding region on the inner periphery of the guide hole 83. This can reduce the inclination of the lifter body 11 in the guide hole 83 more reliably.

Furthermore, in the foregoing embodiment, the one axial end of the skirt 13 is disposed at a position deviated from the rotation trajectory of the cam 70 so as to be horizontal at the same level. Accordingly, the cylindrical part 12 can ensure a further wide sliding region on the inner periphery of the guide hole 83, and the grinding work can easily carried out by the centerless processing or the like while the lifter body 11 is rotated.

The above-described lifter may be applied to a valve lifter provided on a valve gear.

Furthermore, the skirt 13 may be provided with an expanding slot which is formed between the arc-shaped portion 14 having an arc-shaped surface slidable on the inner periphery of the guide hole 83, and the flat portions 26 to which the both ends of the support shaft 31 for the roller 30 are fixed, in order to separate both portions.

Furthermore, the rotation stopper 21 may be formed by forcedly bending outward a part of the cylindrical part 12 protruding from the other axial end to the other axial side.

Furthermore, the cylindrical body 16 may be formed to be thicker than the skirt 13. In this case, the rotation stopper 21 may be formed to be thicker than the skirt 13, and formed to be as thick as or to be thinner than the cylindrical body 16.

What is claimed is:

1. A lifter comprising:

a roller caused to abut against a cam thereby to be pressed; and a lifter body rotatably supporting the roller and housed in a guide hole of a lifter guide so as to be reciprocable in the guide hole, wherein;

the lifter body has a cylindrical part which is cylindrical in shape;

the cylindrical part has a skirt at one of two axial sides thereof and a cylindrical body at the other of the two axial sides;

the cylindrical body has a rotation stopper protruding outward from an end at the other axial side opposite the side where the skirt is located, the rotation stopper preventing the lifter body from rotated about an axis thereof relative to lifter guide;

the skirt has an arc-shaped portion;

the arc-shaped portion and the cylindrical body have respective outer peripheries which are axially steplessly continuous to be formed into a sliding surface slidable on an inner periphery of the guide hole.

2. The lifter according to claim 1, wherein the lifter body is integrally formed by forging.

3. The lifter according to claim 1, wherein the rotation stopper is formed to be thicker than the skirt.

4. The lifter according to claim 1, wherein:

the skirt includes a pair of flat portions parallel to each other;

the flat portions have respective shaft support holes through which a support shaft of the roller is coaxially inserted;

the skirt has a part excluding the flat portions, the part serving as the arc-shaped portion;

the flat portions are disposed opposite to end surfaces of the roller so as to cover the end surfaces of the roller respectively; and the arc-shaped portion is disposed opposite to an outer periphery of the roller so as to cover the outer periphery of the roller.

5. The lifter according to claim 1, Wherein the skirt has an axial end which is disposed at a position deviated from a rotation trajectory of the cam so as to be continuous at a constant level.

6. The lifter according to claim 1, wherein the rotation stopper is formed into a general L-shape including a part protruding from the end at the other axial side of the cylindrical body to the other axial side and a part bent radially outward from a protruding end of the part protruding to the other axial side.

7. The lifter according to claim 1 wherein the lifter body has a monolithic, single unit structure.

8. A lifter comprising:

a roller caused to abut against a cam thereby to be pressed; and a lifter body rotatably supporting the roller and being configured as to be housed in a guide hole of a lifter guide so as to be reciprocable in the guide hole, wherein;

the lifter body has a cylindrical part which is cylindrical in shape and extends from a first axial end to a second axial end of the lifter body;

the cylindrical part has a skirt at the first axial end of the lifter body and a cylindrical body at the second axial end of the lifter body;

the cylindrical body has a rotation stopper protruding outward from a free edge of the lifter body defining the second axial end of the lifter body, the rotation stopper being configured to prevent the lifter body from being rotated about an axis thereof relative to the lifter guide;

the skirt has an arc-shaped portion;

the arc-shaped portion and the cylindrical body have respective outer peripheries which define, together, a stepless, continuous sliding surface that extends from the free edge at the second axial end of the lifter body to the first axial end of the lifter body and is slidable on an inner periphery of the guide hole.

9. The lifter according to claim 8, wherein the lifter body is integrally formed by forging.

10. The lifter according to claim 8, wherein the rotation stopper is formed to be thicker than the skirt.

11. The lifter according to claim 8, wherein:

the skirt includes a pair of fiat portions parallel to each other;

the fiat portions have respective shaft support holes through which a support shaft of the roller is coaxially inserted;

the skirt has a part excluding the fiat portions, the part serving as the arc-shaped portion;

the flat portions are disposed opposite to end surfaces of the roller so as to cover the end surfaces of the roller respectively; and the arc-shaped portion is disposed opposite to an outer periphery of the roller so as to cover the outer periphery of the roller.

12. The lifter according to claim 8, wherein the skirt has a free edge at the first axial end of the lifter body which is disposed at a position deviated from a rotation trajectory of the cam so as to be continuous at a constant level.

13. The lifter according to claim 8, wherein the rotation stopper is formed into a general L-shape, including a first L-shape part protruding axially away from the free edge defining the second axial end of the lifter body, and a second L-shaped part extending radially outward from a protruding end of the first L-shaped part.

14. The lifter according to claim 8 wherein the lifter body has a monolithic, single unit structure.

* * * * *